United States Patent [19]

Shafran

[11] 4,388,915

[45] Jun. 21, 1983

[54] HEAT GENERATOR FOR A CIRCULATING HEATING SYSTEM

[76] Inventor: Dimitry Shafran, 67 Russwin Rd., New Britain, Conn. 06053

[21] Appl. No.: 186,185

[22] Filed: Sep. 11, 1980

[51] Int. Cl.[3] ..... F24C 9/00; F22B 3/06

[52] U.S. Cl. ..... 126/247; 122/26

[58] Field of Search ..... 126/247; 122/26; 237/12.1; 165/86, 89; 415/76, 90

[56] References Cited

U.S. PATENT DOCUMENTS

| | | | |
|---|---|---|---|
| 854,720 | 5/1907 | Dawson | 122/26 |
| 1,366,455 | 1/1921 | Henson | 126/247 |
| 1,718,175 | 6/1929 | Nilson | 122/26 |
| 3,933,007 | 1/1976 | Eskeli | 126/247 |
| 4,271,790 | 6/1981 | Ahmed et al. | 122/26 |

*Primary Examiner*—Samuel Scott
*Assistant Examiner*—Randall L. Green
*Attorney, Agent, or Firm*—McCormick, Paulding & Huber

[57] ABSTRACT

A frictional heat generator for fluid used in a circulating heating system. The generator has a closed housing wherein a hollow shaft is driven to rotate perforate rotor discs which are secured in spaced apart relationship along the shaft. A generally cylindrical structure within the housing supports a series of annular perforated stator discs. A fluid heating medium is introduced to the bore of the shaft and passes through suitable openings in the shaft into the restricted housing area where the rotor and stator discs are disposed. Centrifugal force moves the fluid outwardly while it is being violently acted upon by the shearing-like action of the perforate discs. The total movement of the fluid and the action it undergoes generates heat within the fluid, and the fluid flows through appropriate generally radial channels in the cylindrical structure from the restricted area within that structure into the housing chamber around the structure which might be considered a reservoir. The heated fluid is pumped from the reservoir through radiators or the like in a generally conventional circulating heating system before it is returned to the generator for recycling.

12 Claims, 7 Drawing Figures

HEAT GENERATOR FOR A CIRCULATING HEATING SYSTEM

BACKGROUND OF THE INVENTION

The heat producer or generator of this invention is intended for use in circulating heating systems in residential and commercial or industrial installations of the type designed to use a fluid heating medium. The generator produces heat within the medium by friction, and thus is intended to replace conventional combustion type generators in such systems. It is the general object of the invention to provide an energy efficient, compact, and long lasting heat generator for fluid medium heating systems.

SUMMARY

The invention resides in the design and arrangement of the shaft, the perforate rotor and stator discs, and the cylindrical structure which surrounds the relatively moving discs within the generator housing. In this connection, every perforation or hole in each of the stator and rotor discs is chamfered at each end through nearly 180° of its circumference, but the chamfered edge portions of the holes in the rotor discs are arranged generally on the opposite side of the holes from the chamfered edge portions of the holes in the stator discs. More specifically, if one viewed a rotor disc along the axis of the generator shaft turning in a clockwise direction, the chamfered edge portion of each perforation or hole would face the clockwise direction. The chamfered edge portion of each perforation or hole in a stator disc would face the counterclockwise direction. This arrangement enhances the desired shearing action of the relatively moving discs in the body of the fluid and increases the efficiency of heat generation without undo turbulence.

Also, the surrounding cylindrical structure is made up of a series of spacer rings or restrictor rings located between adjacent stator discs, and the inner peripheries of such spacer or restrictor rings are provided with scallops which also causes shearing or frictional action in the fluid without undo turbulence, further to increase the frictional heat generating efficiency. Additionally, the restrictor-spacer rings are provided with circumaxially spaced channels along each face of each such ring for the flow of the heated fluid outwardly from the generally cylindrical structure into the housing chamber or cavity surrounding the generally cylindrical structure. This portion of the housing chamber may be considered a reservoir for the heated fluid medium, and the fluid is pumped from the reservoir for circulation through the system.

THE PREFERRED EMBODIMENT

Figure 1:
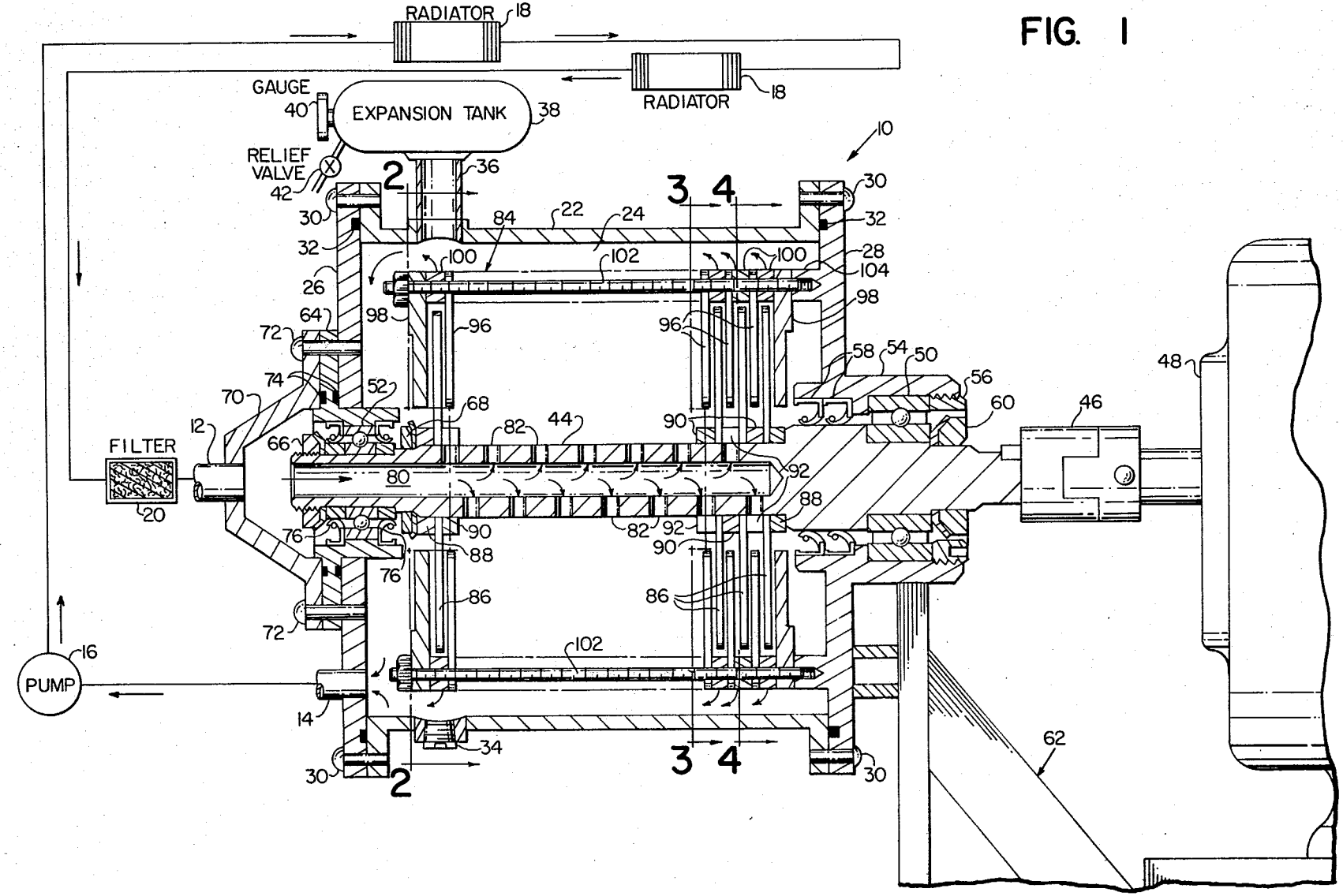
FIG. 1 is a longitudinal cross sectional view through a heat generator provided in accordance with the present invention, and the circulating system or circuit is illustrated schematically to show the connection of the generator in the system.

In the various views of the drawings, the friction heat generator provided in accordance with this invention is indicated generally by the reference number 10, and in FIG. 1 there is a schematic illustration of the manner in which the said generator is connected into a conventional fluid circulating heating system. More specifically, the generator 10 is provided with an inlet conduit 12 receiving relatively cool fluid from the system, and it has an outlet 14 for discharging the fluid back into the system after it has been heated by the generator.

The system shown may be characterized as a forced circulating system in that it has a pump 16 which forces the heated fluid medium from the generator discharge 14 through a series of radiators 18, 18 where it is cooled as the radiators heat rooms or other surrounding areas where heat is required. The pump continues to force the now relatively cool fluid medium through a filter 20 and then back into the generator 10 through its inlet port or conduit 12.

An important element of the generator 10 is a housing which includes a preferably cylindrical body 22 which, in any shape provided, defines a cylindrical chamber 24 which is closed at the front end by a front plate 26 and at the rear by a plate 28. As shown in the drawings, the end plates 26 and 28 can conveniently be secured to the housing body 22 by providing the said body with radially extending flanges at its front and rear ends and by extending machine screws 30, 30 through the end plates into the associated body flanges. "O" ring seals 32, 32 are provided between the end plates and the body flanges to prevent the escape of the fluid heating medium from the housing. A drain plug 34 is threaded into the bottom of the housing, and a conduit 36 extends from the top of the housing to an expansion tank 38. A gauge 40 can be connected to the expansion tank to provide a visual indication of the pressure of the fluid heating medium in the system, and a conventional relief valve 42 can also be connected to the expansion tank for operation at a preselected pressure.

Another important element of the frictional heat generator 10 is a shaft 44 which is connected through a coupling 46 to an electric motor 48 so as to be driven thereby. The said shaft can be conveniently supported for rotation in the housing chamber 24 so as to project forwardly therein on rear and front antifriction bearing units 50 and 52 respectively. More specifically, the rear end plate 28 of the housing is provided with a journal boss 54 wherein the bearing unit 50 is secured by a nut 56. At the front end of the boss 54, conventional seal units 58, 58 are located to surround the shaft 44 and to prevent the loss of the fluid heating medium from the housing chamber 24 through the boss and the rear bearing unit 50. A lock nut and associated washer unit 60 secures the shaft and the rear bearing unit 50 in position in the housing and relative to the drive motor 48. In this connection, it is desirable to mount the drive motor 48 and the rear plate 28 of the housing on a common base indicated generally by the reference numeral 62 so that the shaft 44 will be substantially aligned with the output shaft of the motor and so that any misalignment can easily be taken up by the conventional coupling 46.

The front bearing unit 52 for the shaft 44 is mounted in a bushing 64 which is thrust through a suitable opening in the front housing plate 26. The said shaft and bearing unit are secured in place by conventional lock nuts 66 and 68, and a forwardly projecting hollow cap 70 is secured to the bushing 64 and to the front plate 26 by a circumaxial series of machine screws 72, 72. The connection between the cap, bushing and front plate is made fluid tight by O-ring seals 74, 74, and suitable seal units 76, 76 prevent the flow of fluid around the shaft and through the bearing unit 52. The inlet conduit 12 for the generator 10 is threaded into the front end of the cap 70 in coaxial alignment with the shaft 44, and the discharge conduit 14 is threaded into the front wall 26 near the bottom thereof.

The fluid which is pumped into the generator enters the open front end of an axial bore 80 in the shaft 44 and which extends rearwardly through a substantial portion of the length of the shaft disposed in the housing chamber 24. This flow of the fluid is indicated by the arrows, and it will be noted that the shaft has a longitudinally spaced apart and staggered series of transverse openings 82, 82 through its wall from the bore and into the housing chamber 24. These openings accommodate the flow of the fluid heating medium from the system into the interior of a generally cylindrical structure which is indicated generally by the reference number 84 within the housing chamber 24 and wherein the fluid is subjected to heat of friction produced by the relative movement of a series of rotor discs and stator discs which will be described.

Figure 4:
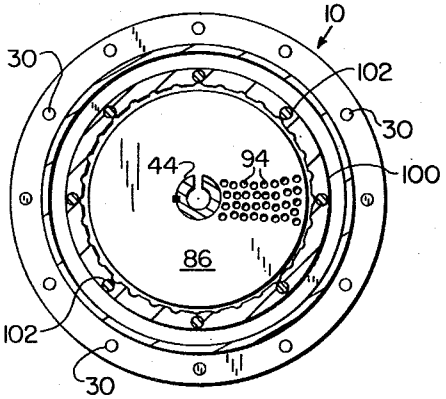
FIG. 4 is also a reduced scale transverse sectional view taken as indicated by the line 4—4 of FIG. 1.
Figure 3:
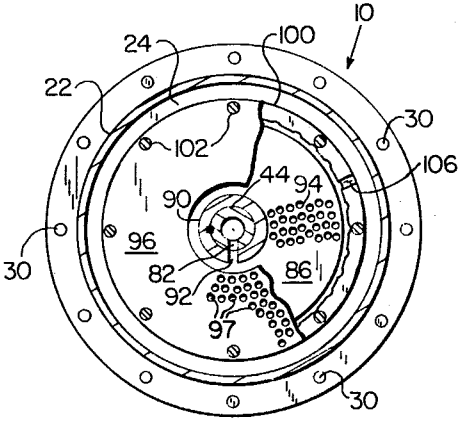
FIG. 3 is a further transverse sectional view, but on reduced scale, taken as indicated by the line 3—3 of FIG. 1.
Figure 5:
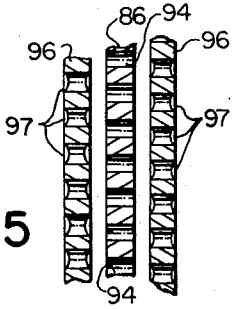
FIG. 5 is a cross sectional view taken through portions of adjacent rotor and stator discs to illustrate the arrangement of the perforations therein relative to each other.
Figure 2:
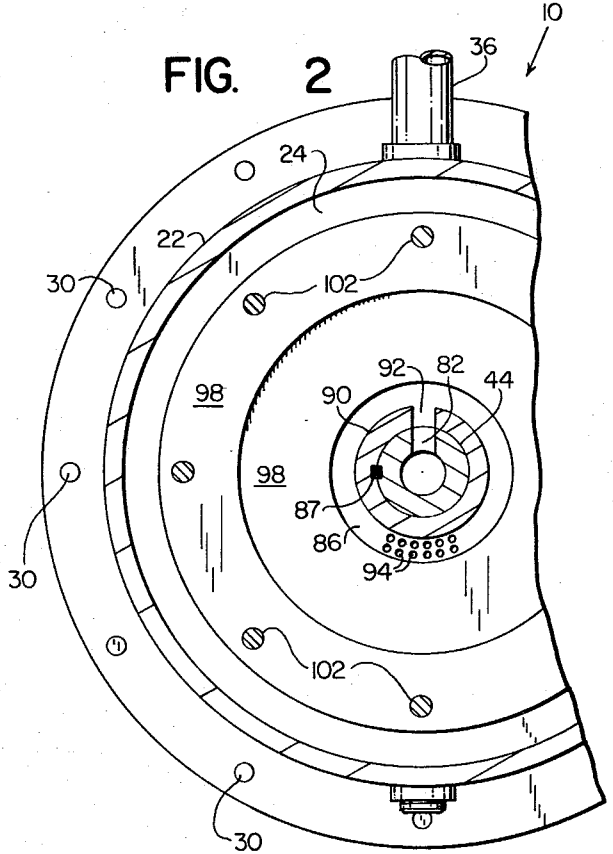
FIG. 2 is a transverse sectional view through the generator taken as indicated by the line 2—2 of FIG. 1.

Each rotor disc is designated by the reference number 86, and it will be observed that there are a series of such rotor discs located along the shaft 44 in equal longitudinal spacing to each other. Each rotor disc 86 is keyed (as by key 87) or otherwise secured to the shaft 44 for rotation therewith and they are held in the aforesaid longitudinally spaced relationship by end spacer rings 88, 88 and by intermediate spacer rings 90, 90. Each intermediate spacer 90 has a radial opening 92 therein which is aligned with one of the transverse openings 82 in the shaft 44 to pass the heating medium from the interior bore 80 of the shaft into the space between adjacent rotor discs 86, 86. As best shown in FIGS. 3, 4 and 5, each rotor disc 86 is perforate, the perforations being indicated by the reference number 94.

It is the generally cylindrical structure 84 which supports the series of annular stator discs each of which is designated by the reference number 96 and each of which is also perforate as shown in FIGS. 3, 4 and 5 wherein each perforation is shown by the reference number 97. It will be observed in FIG. 1 that the stator discs 96, 96 are interspersed between the rotor discs 86, 86 and that their inner peripheries terminate in spaced relationship to the spacer rings 90, 90 which support the rotor discs.

As mentioned above, the generally cylindrical structure 84 supports the stator discs. This structure includes a pair of imperforate outer discs 98, 98, one at each end of the cylindrical structure and a plurality of restrictor and spacer rings 100, 100 which are interspersed between the stator discs 96, 96 to maintain equal longitudinal spacing between them. The end discs 98, 98, the spacer and restrictor rings 100, 100 and the stator discs 96, 96 are all secured as shown in FIG. 1 by a circumaxially spaced series of elongated studs 102, 102 which are threaded into an internal annular boss 104 on the rear plate 28 of the generator housing. It will be seen that the rotor discs 86, 86 terminate at their outer periphery in spaced relationship to the restrictor and spacer rings 100, 100 and that the spacing of a rotor disc 86 to a stator disc 96 on each of its sides is the same.

The fluid heating medium which is pumped into the bore 80 of the shaft 44 and then out through the radial openings 82, 82 in the shaft and through the radial openings 92, 92 of the spacer rings 90, 90 under pump force, enhanced by the centrifugal force effected by rotation of the shaft, moves into the restricted area within the generally cylindrical structure 84 wherein the rotor discs 86 and the stator discs 96 are located. The rotary motion of the rotor discs relative to the stationary stator discs may be likened to a shearing action through the fluid, and the perforations in the said rotor and stator discs enhance this shearing motion in the body of fluid within the housing for the generator 10. It is this shearing motion or action which generates heat by the friction involved within the body of fluid.

It is believed that this heat generation, by what may be likened to a shearing action, is enhanced by the chamfer configuration and arrangement of each perforation or hole in each of the rotor and stator discs. As has been described, the chamfered edge portion of each hole in a rotor disc faces in the rotary direction of the rotor disc (clockwise, for example), while the chamfered edge portion of each hole a stator disc faces the opposite rotary direction (counterclockwise, in the same example). This is shown in FIG. 5 which is a cross sectional view through two stator discs 96, 96 sandwiching a rotor blade 86 as they would appear when facing oppositely of the rotary direction (counterclockwise in the foregoing example).

Figure 6:
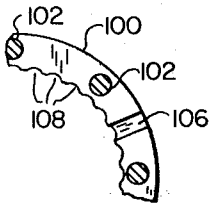
FIG. 6 is an elevational view of a segment of a spacer and restrictor ring disposed between adjacent stator discs.

After undergoing such shearing action and heating, the fluid is discharged radially outwardly of the generally cylindrical structure 84 through circumaxially spaced channels 106, 106 (FIGS. 3 and 6) which are provided in the faces of each of the restrictor and spacer rings 100, 100. It has been found that four such channels 106 in each spacer and restrictor ring 100 (two diametrically opposed channels on each face) when properly sized as to width and depth will restrict the flow of fluid from within to without. of the generally cylindrical structure 84 to assure a substantially complete distribution of fluid wholly within the structure 84 and between the rotor and stator discs.

It has also been found that the shearing action, and thus the heat generation of the body of the fluid medium can be enhanced by providing a series of channels 108, 108 extending from one face to the other face of each spacer and restrictor ring 100, the said channels being evenly circumaxially spaced around the inner periphery of each such ring. The provision of the inner periphery channels or scallops 108, 108 and the arrangement of the perforations in adjacent rotor and stator discs enhances the generation of heat within the fluid medium without undo or unexpected turbulence which might interfere with the flow of the fluid into and out of the generator and through the system.

The length of the housing, the length of the shaft, and the number of rotor and stator discs depend upon the size of the system with which the generator is connected and the volume of fluid to be passed. These factors do not depend upon the particular fluid heating medium that is employed. There are many suitable fluids available, preferably liquid, within the class of oil, transmission fluids, lubricants and synthetics with silicone additives where desired.

Figure 7:
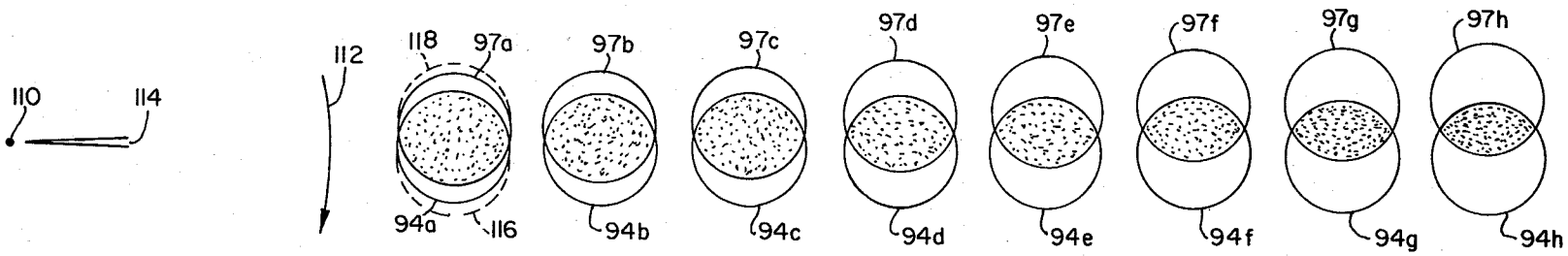
FIG. 7 is a schematic illustration of the shearing action taking place in the fluid medium and caused by the relative movement of the rotor and stator discs.

As has been mentioned, the relative rotational motion between the rotor and stator discs can be likened to a shearing action, and this is schematically illustrated in FIG. 7. The preferred arrangement of the perforations 94, 94 in each rotor disc 86 and the perforations 97, 97 in each stator disc 96 are the same. That is, the perforations in each disc are arranged in circumaxial series so that the inner ring of perforations in a rotor disc and the inner ring of perforations in a stator disc lie at the same radial distance from the axis of the shaft 44. Likewise, the outer ring of perforations in each rotor and stator disc lie at the same radial distance from the axis of the shaft and all rings of perforations intermediate the inner and outer rings are on equal radii from the axis of the shaft.

This is schematically illustrated in FIG. 7 (which is not drawn to scale or proportion) wherein the center line or axis of the shaft 44 is indicated by the reference number 110. Also in FIG. 7, the direction of rotation of each rotor disc when viewed along the shaft axis 110 is clockwise as indicated by the arrow 112. For purposes of illustration, there is one perforation 94*a* in the inner circle of perforations in the rotor disc shown and there is one perforation 97*a* in the inner circle of perforations in the stator disc shown. In similar fashion there are perforations 94*b*–94*h* shown from each of the next seven rings of perforations in a rotor disc and the corresponding perforations 97*b*–97*h* in the next seven rings of perforations in the adjacent stator disc are shown.

Further, FIG. 7 illustrates what occurs in the movement of a rotor disc through a small angle 114. At the start of the movement through the angle 114, each rotor disc perforation 94*a*–94*h* is coaxial with the respective perforations 97*a*–97*h* in the adjacent stator disc. The shading or stippled areas shown in the drawing are of elliptical shape and illustrate the shearing action which takes place in the perforations as the rotor disc moves through the small angle 114. In such movement the overlying portions of the perforations 94*a* and 97*a* change from the complete circular configuration of the apertures to the elliptical configuration shown wherein the minor axis of the ellipse is relatively great. The relative movement of the apertures 94*b* and 97*b* is greater and the overlying portions change from the circular to an elliptical area wherein the minor axis is somewhat less than the ellipse shown in connection with the apertures 94*a* and 97*a*. Thus, in the outward radial direction from the center line of the shaft the relative movement between overlying apertures is greater and this is graphically illustrated by the reduction in the minor axis of the ellipses shown in the shaded or stippled areas.

It is this shear-like action between adjacent rotor and stator discs in the body of the heating medium which generates the heat within such body. As mentioned earlier, it is believed that this shear-like action is enhanced by providing the chamfers on one side or through approximately 180 degrees of arc on each perforation. A chamfered edge for the perforation 94*a* is shown at 116 facing in the clockwise direction of rotation of the rotor disc, and the chamfered edge 118 of the corresponding perforation 97*a* in the adjacent stator disc is shown to face in the counterclockwise direction. All of the perforations 94*b*–94*h* have chamfered edges like the edge 116 and all of the perforations 97*b*–97*h* have chamfered edges like the edge 118.

FIG. 7 further illustrates that the relative movement between the disc perforations is greater as the outside diameter of the discs is approached. Thus, it is believed that the rate of temperature increase within the body of fluid in the heat generator 10 is greater with an increase in radial distance from the axis of the rotating shaft 44. This is quite desirable because the fluid introduced in the bore of the axis is relatively cold. Therefore, it is believed to be desirable to increase its temperature more rapidly as the fluid is circulated from the central part of the heat generator to the radially outer part thereof.

I claim:

1. A frictional heat generator for fluid to be used in a circulating system, comprising a housing defining a substantially cylindrical closed-end chamber, a driven shaft rotatably supported on the longitudinal axis of said housing chamber in sealed relationship with the housing to prevent the flow of fluid to and from the housing chamber around said shaft, said shaft being provided with an axial bore extending from one end through a substantial part of its length within the housing and also being provided with longitudinally and circumaxially spaced transverse radial openings through its wall from the bore into the housing chamber, means supporting a longitudinally spaced series of perforated rotor discs along said shaft for rotation therewith, a cylindrical structure supported within the housing chamber in radially inward spaced relation to the housing and supporting a longitudinal series of perforated annular stator discs within the housing chamber so that a stator disc is disposed between adjacent rotor discs in spaced relationship, the cylindrical structure including a series of stator spacer rings arranged one between each pair of adjacent stator discs and secured to the housing, each stator spacer ring being provided with a plurality of circumaxially spaced radial channels for the flow of fluid outwardly into the housing chamber from the area within said cylindrical structure wherein the rotor and stator discs are located, the inner periphery of the stator discs being radially spaced outwardly from the shaft, and the outer periphery of the rotor discs being radially spaced inwardly from the said cylindrical structure, means for introducing fluid under pressure to the shaft bore during shaft rotation which then flows to the housing chamber through the radial openings in the shaft to be subjected to heat by friction caused by the relative motion of the rotor and stator discs, and conduit means connected to the housing for receiving and circulating the friction heated fluid.

2. A frictional heat generator for fluid to be used in a circulating system, comprising a housing defining a substantially cylindrical closed-end chamber, a driven shaft rotatably supported on the longitudinal axis of said housing chamber in sealed relationship with the housing to prevent the flow of fluid to and from the housing chamber around said shaft, said shaft being provided with an axial bore extending from one end through a substantial part of its length within the housing and also being provided with longitudinally and circumaxially spaced transverse radial openings through its wall from the bore into the housing chamber, means supporting a longitudinally spaced series of perforated rotor discs along said shaft for rotation therewith, a cylindrical structure supported within the housing chamber in radially inward spaced relation to the housing and supporting a longitudinal series of perforated annular stator discs within the housing chamber so that a stator disc is disposed between adjacent rotor discs in spaced relationship, the inner periphery of the stator discs being radially spaced outwardly from the shaft, and the outer periphery of the rotor discs being radially spaced inwardly from the said cylindrical structure, the perforations in each of the rotor and stator discs being chamfered at their ends throughout a portion of their circumference, means for introducing fluid under pressure to the shaft bore during shaft rotation which then flows to the housing chamber through the radial openings in the shaft to be subjected to heat by friction caused by the relative motion of the rotor and stator discs, and conduit means connected to the housing for receiving and circulating the friction heated fluid.

3. A frictional heat generator for fluid to be used in a circulating system, comprising a housing defining a substantially cylindrical closed-end chamber, a driven shaft rotatably supported on the longitudinal axis of said housing chamber in sealed relationship with the housing to prevent the flow of fluid to and from the housing chamber around said shaft, said shaft being provided with an axial bore extending from one end through a substantial part of its length within the housing and also being provided with longitudinally and circumaxially spaced transverse radial openings through its wall from the bore into the housing chamber, means supporting a longitudinally spaced series of perforated rotor discs along said shaft for rotation therewith, a cylindrical structure supported within the housing chamber in radially inward spaced relation to the housing and supporting a longitudinal series of perforated annular stator discs within the housing chamber so that a stator disc is disposed between adjacent rotor discs in spaced relationship, the cylindrical structure including a series of stator spacer rings arranged one between each pair of stator discs, the inner periphery of the stator discs being radially spaced outwardly from the shaft, and the outer periphery of the rotor discs being radially spaced inwardly from the said cylindrical structure, the stator discs and the stator spacer rings cooperating to define a plurality of radial passageways for the flow of fluid outwardly into the housing chamber from the area within the cylindrical structure wherein the rotor and stator discs are located, means for introducing fluid under pressure to the shaft bore during shaft rotation which then flows to the housing chamber through the radial openings in the shaft to be subjected to heat by friction caused by the relative motion of the rotor and stator discs, and conduit means connected to the housing for receiving and circulating the friction heated fluid.

4. A heat generator as defined in either claim 1 or claim 2 wherein the means supporting the rotor discs comprises a series of rotor spacer rings arranged one between each pair of adjacent rotor discs and secured to the shaft for rotation therewith, each rotor spacer ring being provided with a radial opening aligned with one of the radial openings in the wall of the shaft.

5. The heat generator of claim 2 wherein the cylindrical structure supporting the stator discs comprises a series of stator spacer rings arranged one between each pair of adjacent stator discs and secured to the housing, each stator spacer ring being provided with a plurality of cicumaxially spaced radial grooves along at least one of its faces for the flow of fluid outwardly into the housing chamber from the area within said cylindrical structure wherein the rotor and stator discs are located.

6. A heat generator as set forth in either claim 1 or claim 5 wherein the inner peripheries of the stator spacer rings are provided with regularly spaced apart grooves extending between the faces of each stator spacer ring.

7. The generator defined in either claim 1 or claim 2 wherein the means for introducing fluid to the shaft bore is disposed at one end of the said housing and is adapted to introduce the fluid to the said bore at the said one end of the shaft, and the conduit means is connected to the housing at the said one end thereof.

8. The frictional heat generator defined by claim 1 wherein the perforations in each of the rotor and stator discs are chamfered at their ends throughout a portion of their circumference.

9. The generator of claim 6 or claim 2 wherein the rotor and stator discs are so arranged relative to each other that the chamfered edge portions in the perforations of adjacent rotor and stator discs face opposite rotary directions.

10. The frictional heat generator of claim 1 wherein the means for introducing fluid to the shaft bore is disposed at one end of the said housing and is adapted to introduce the fluid to the said bore at the said one end of the shaft, and the conduit means is connected to the housing at the said one end thereof.

11. The frictional heat generator as set forth in either claim 1 or claim 2 wherein the perforations in the rotor discs and stator discs are similarly arranged and spaced and whereby in at least one rotated position of the rotor discs the perforations in all of the rotor and stator discs will be in axial alignment.

12. The frictional heat generator as set forth in claim 9 wherein the perforations in the rotor discs and stator discs are similarly arranged and spaced and whereby in at least one rotated position of the rotor discs the perforations in all of the rotor and stator discs will be in axial alignment.

* * * * *